United States Patent [19]

Ladusaw

[11] 4,331,002

[45] May 25, 1982

[54] ROTARY COMPRESSOR GAS INJECTION

[75] Inventor: William T. Ladusaw, Louisville, Ky.

[73] Assignee: General Electric Company, Louisville, Ky.

[21] Appl. No.: 243,174

[22] Filed: Mar. 12, 1981

[51] Int. Cl.[3] ..... F25B 31/00

[52] U.S. Cl. ..... 62/505; 62/197; 62/512

[58] Field of Search ..... 62/196 R, 197, 512, 62/505

[56] References Cited

U.S. PATENT DOCUMENTS

| | | | |
|---|---|---|---|
| 2,904,973 | 9/1959 | Kosfeld | 62/324.6 |
| 3,105,633 | 10/1963 | Dellario | 417/310 |
| 3,109,297 | 5/1963 | Rinehart | 62/197 |
| 3,111,820 | 11/1963 | Atchison | 62/505 |
| 3,191,403 | 6/1965 | Ladusaw | 62/505 |
| 3,210,958 | 10/1965 | Coyne | 62/324.6 |
| 3,767,328 | 7/1972 | Ladusaw | 417/310 |
| 4,049,410 | 9/1977 | Miller | 62/505 |

*Primary Examiner*—Ronald C. Capossela

*Attorney, Agent, or Firm*—Frank P. Giacalone; Radford M. Reams

[57] ABSTRACT

The invention relates to increasing the pumping efficiency of a rotary compressor and, more particularly, to an arrangement for supplying uncondensed gaseous refrigerant from the inlet of the evaporator to the compression chamber when the pressure in the compression chamber is less than evaporator inlet pressure.

7 Claims, 4 Drawing Figures

ROTARY COMPRESSOR GAS INJECTION

BACKGROUND OF THE INVENTION

Generally, in a closed refrigeration system, high pressure gaseous refrigerant discharged from the compressor is condensed to a high pressure liquid. As this high pressure, subcooled liquid refrigerant passes through the system capillary, the temperature drops, typically from 115° to 45° F., while the pressure drops from 300 PSIG to 76 PSIG. In the process of this cooling, some saturated vapor forms and is present in the line leading to the evaporator. This gas must pass through the evaporator along with the liquid which is in the process of evaporation as it picks up heat from the evaporator surface.

Ideally, in a system employing Freon 22 having a pressure and temperature of 76 PSIG and 45° F. respectively, at the entrance to the evaporator the pressure and temperature would be the same at the evaporator exit. However, the presence of gaseous refrigerant at the evaporator entrance as opposed to pure liquid refrigerant increases or results in a pressure drop across the evaporator. To overcome this pressure drop, the systems and more particularly the evaporator are designed to accommodate the presence of some gas and the resulting pressure drop. This is generally accomplished by increasing the effective length or inside diameter of the evaporator tubing which results in the use of extra material and, accordingly, adding cost to the system.

SUMMARY OF THE INVENTION

By the present system, means are provided to lower the evaporator inlet pressure by bleeding off gaseous refrigerant so that only liquid refrigerant enters the evaporator. This results in a more efficient evaporator for the same size and length of tubing, or one can maintain the efficiency of the system by employing an evaporator having a shorter length of tubing.

By the present invention, means to provide a refrigerant system wherein gaseous refrigerant, when present at the evaporator inlet, is directed to the compression chamber of a rotary compressor.

When the gas at saturated temperature is bled from the evaporator entrance and injected into the compression chamber of a rotary compressor, it lowers the BTU/LB heat content of the gas before compression and make the gas more dense. The normal effective displacement of the rotary compressor is increased with the added volume of gas by increasing the lbs/hr pumped by the compressor each revolution. This results in a more efficient or large displacement compressor for the same given compression chamber volume or effective displacement.

In accordance with the preferred embodiment of the invention, there is provided a refrigeration system including a condenser, an evaporator, an expansion control means dividing the system between a low and high pressure side and a hermetically sealed rotary refrigerant compressor for forming a closed refrigeration circuit. The rotary compressor comprises a hermetic casing adapted to contain a high pressure refrigerant gas wherein is located a compressor unit including a cylinder having an annular compression chamber and end walls enclosing the ends of the annular chamber. A rotor eccentrically rotatable within the chamber and having a peripheral surface is adapted to move progressively into sealing relation with successive portions of the annular chamber. The hot compressed refrigerant gas is discharged from the chamber through a discharge port into the casing and then to the condenser. Gaseous refrigerant from the evaporation outlet is conducted to the low pressure side of the chamber through a suction port.

A refrigerant collecting means is arranged in the low pressure side at the inlet to the evaporator. The collecting means being dimensioned for separating gaseous uncondensed refrigerant from liquid condensed refrigerant. The uncondensed gaseous refrigerant from the collecting means is injected into the annular chamber through a gaseous refrigerant injection port positioned to be covered and uncovered by the rotor during rotation thereof. A refrigerant gas supply means is provided for conducting uncondensed gas refrigerant when present in the collection means to the injection port for discharge into the chamber when the pressure in the chamber is less than the pressure in the collecting means so as to prevent back flow of compressed refrigerant into the collecting means.

DESCRIPTION OF THE PREFERRED EMBODIMENT

Figure 1:
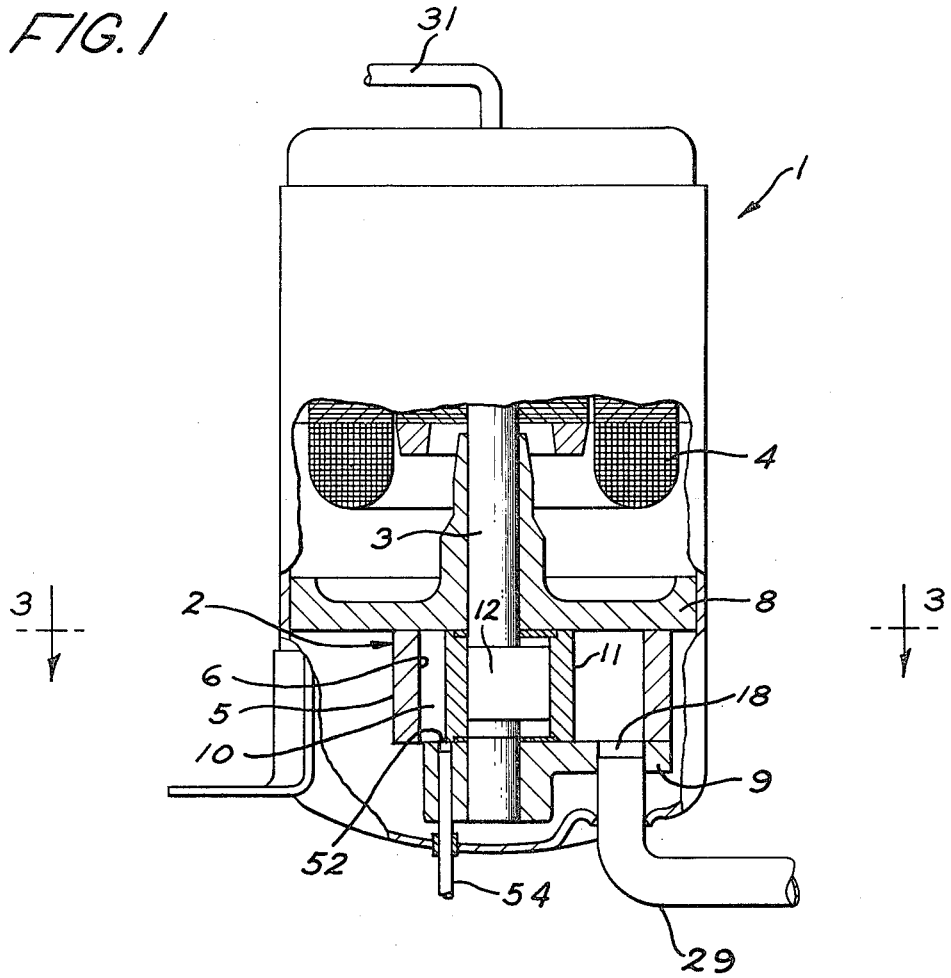
FIG. 1 is a side elevational view partially in section of a hermetically sealed rotary compressor incorporating the present invention.
Figure 3:
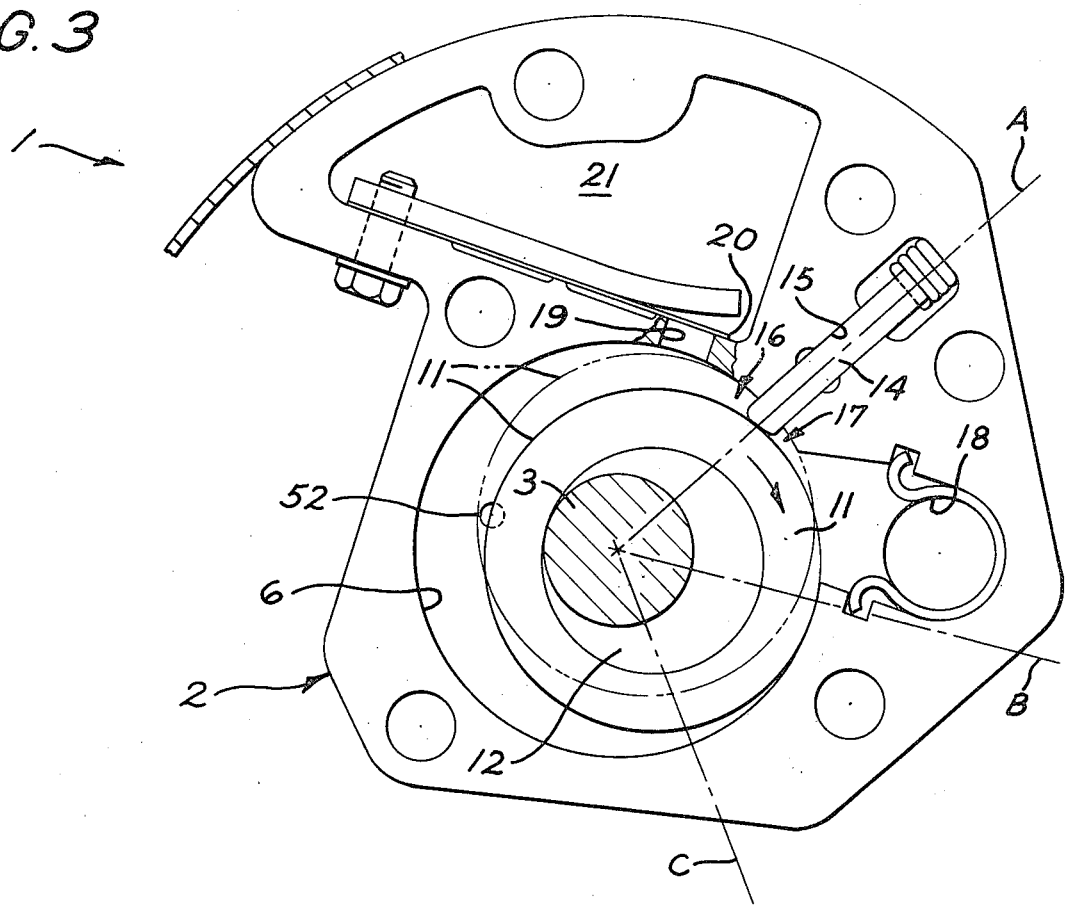
FIG. 3 is a partial plan view along lines 3—3 of FIG. 1.
Figure 4:
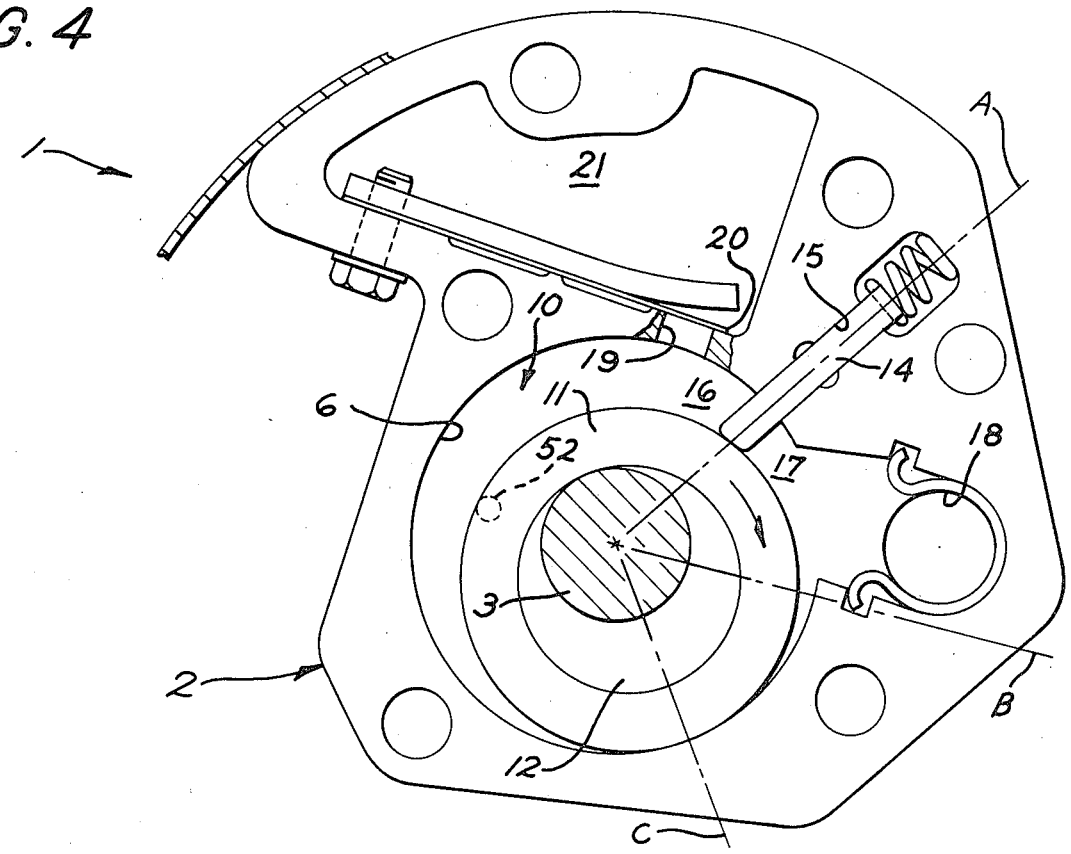
FIG. 4 is a view similar to FIG. 3 showing the rotary compressor at a different point in the cycle.

With reference to drawings, and more particularly FIGS. 1, 3 and 4, there is shown a hermetic compressor comprising a casing 1 in which there is disposed a rotary compressor 2 connected by means of a drive shaft 3 to an electric motor 4. The compressor includes a cylinder block 5 having an inner cylindrical compression chamber wall surface 6 which, in combination with upper and lower end plated 8 and 9, defines an annular compression chamber 10. A rotor or roller 11 driven by and rotatable on an eccentric 12 on the shaft 3 is contained within the chamber 10. A vane or blade 14 is slidably disposed within a radial slot 15 in the compression chamber wall 6 and is adapted to engage the periphery of the rotor 11 to divide the cylinder into a high pressure side 16 and a low pressure side 17.

Figure 2:
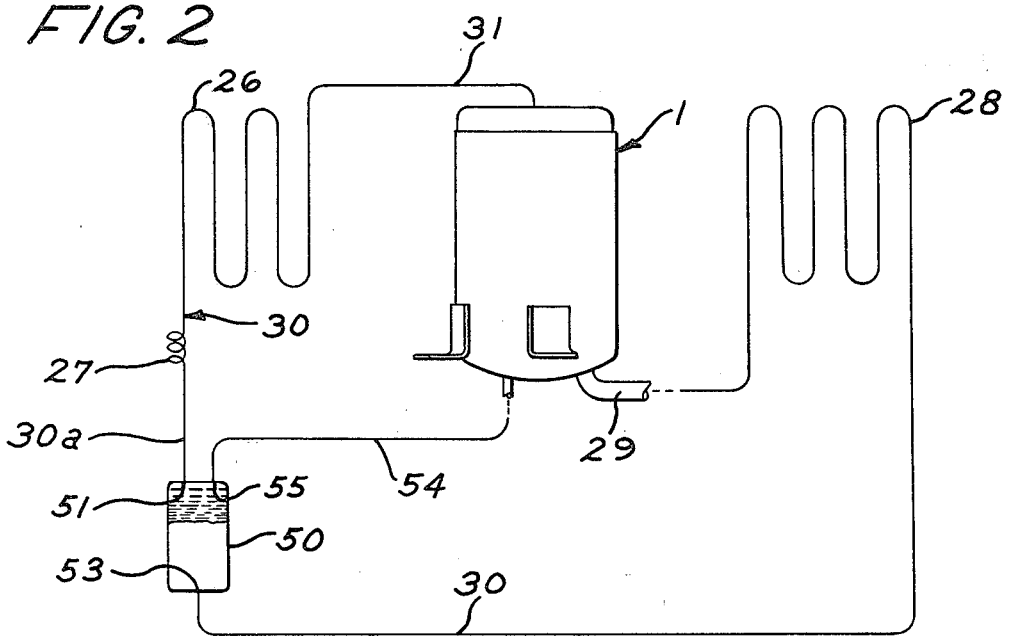
FIG. 2 is a schematic view of a refrigeration system incorporating the present invention.

A low pressure or suction port 18 communicates with the chamber 10 on the low pressure side 17 of the vane 14 and an outlet or discharge port 19 communicates with the high pressure side 16 of the chamber 10 on the opposite side of the vane. The discharge port 19 includes a discharge valve 20 for assuring proper compression of the gases issuing through the discharge port and for preventing reverse flow of discharge gases back into the compression chamber. The discharge gas entering the valve chamber 21 passes through an opening (not shown) in the upper plate 8 into the upper portion of the case 1 through the motor 4. A compressor of this type is adapted to be connected into a refrigeration system as shown, for example, in the schematic of FIG. 2. Such a system, in addition to the compressor, includes a condenser 26, a capillary flow restrictor 27 arranged in the liquid line 30 and an evaporator 28. Low pressure refrigerant is withdrawn from the evaporator 28 through a suction line 29 connected to the suction port 18 and high pressure refrigerant is discharged from the compressor case through a discharge line 31 to the condenser. As the compressor rotor 11 rotates in a clockwise direction, as viewed in FIGS. 3 and 4 of the drawing, low pressure refrigerant is drawn into the compression chamber 10 through the suction port 18, is compressed by rotation of the rotor and the compressed refrigerant is discharged through the discharge port 19.

The operation of the compressor thus far described may be best seen by referring to FIG. 3 wherein the rotor 11 has just completely uncovered the suction port entrance to the compression chamber and suction gases are being drawn into the low pressure side 17 of the chamber 10. As eccentric 12 and shaft 3 rotate clockwise, the rotor 11 is moved around the chamber 10 in a clockwise eccentric movement and increases the volume of the suction or low pressure side 17 of the chamber while it decreases the volume of the high pressure side 16 of the chamber. As the rotor 11 rotates in this direction, the gases within the high pressure side 16 of the chamber are forced in the direction of the discharge port 19 and are compressed within the decreasing volume of the compression chamber. The maximum volume of displacement of the type compressor occurs at a time during the rotation of the rotor when the periphery of the rotor 11 progresses just beyond the opening to the suction port 18. That is, all the volume of gas within the high pressure side 16 of the chamber 10 just after the rotor 11 has passed the suction port opening will be compressed or displaced by the rotor during the remaining portion of its cycle. As will be described, the present invention provides a simple and improved means whereby, in a rotary compressor of this type, the displacement of the compressor may be increased from the above described maximum volume.

In a rotary compressor, the effective displacement is that normal volume entrapped within the compression chamber of the cylinder when the roller first passes the suction port. At this point, the outer surface of the roller tangent to the cylinder bore seals the volume with low pressure suction gas typically 76 PSIG. As the angular rotation of the roller tangent point to cylinder bore moves from suction port cut-off toward the discharge port, compression of gas to a higher pressure due to reduced volume takes place. At some point, approximately 240° of roller rotation from the suction port, head pressure is reached and the discharge valve opens at approximately 300 PSI. During the remaining rotation of the roller cycle, the compressed high pressure gas is forced from the compression chamber, while on the suction side of the roller the tangent point is positioned for the next compression cycle or stroke.

By the present invention, the volume of the effective displacement of the compressor is raised by adding this accumulated volume of gas at the high evaporator inlet pressure to the compression chamber. This refrigerant in gaseous form is present in the system at the end or near the end of the unit capillary restriction section due to the fact that heavy saturated liquid as it passes through the capillary causes a pressure drop and, in the process, bubbles of vapor are formed.

It should be understood that the volume of vapor present is that amount of refrigerant which had to evaporate from liquid to gas in the process of $\Delta P$ to chill the remaining liquid to the lower saturation temperature corresponding to the lower pressure at evaporator inlet. It is this volume of gas from the vapor state of the refrigerant at the end or near the end of the unit capillary restriction section, that is injected into the compression chamber. It should be noted that this gas is injected into the compression chamber after the effective displacement is contained in the chamber, more specifically, at the point that the roller starts the compression portion of the cycle. This increased volume of gaseous refrigerant contained in the compression chamber increases the lbs./hr. pumped by the compressor each revolution and results in a more efficient, and larger displacement compressor for the same given compression chamber volume or effective displacement. The above mentioned pressures and temperatures as well as the following references to pressures and temperature are based on the use of refrigerant 22 and the use of other refrigerants may alter the referenced temperatures and pressures.

By adding the volume of gas at evaporator inlet pressure to that volume entering the compression chamber at the lower suction pressure, the pressure of the gas is raised and compression ratio of the compressor is lowered without motor effort or work. Since the injected gas is at saturated temperature, it lowers the BTU/lb. heat content in the gas before compression and does, in fact, make the gas more dense, not only because the pressure was increased but the cooler gas would contain more lbs./in.$^3$ before compression.

In carrying out the objectives of the present invention, means are provided for separating the gas from liquid refrigerant that is formed by the pressure drop across the capillary at a point upstream of the evaporator inlet and for injecting this gas into the compression chamber. To this end, a refrigerant collecting volume means or container 50 is arranged in the liquid refrigerant line 30 intermediate the capillary 27 and evaporator inlet. The portion of the liquid line leading from the capillary delivers refrigerant through an inlet 51 on the upper wall of container 50. Liquid from the container 50 is delivered to the evaporator 28 through a portion of the liquid line connected at one end to an outlet 53 on the bottom wall of container 50 and at the other end to the evaporator inlet. In effect, liquid refrigerant is present in liquid line 30 between the condenser 26 and capillary tube 27 and between outlet 53 and evaporator 28, the portion of line **30*a*** contains both saturated liquid and saturated gas.

The container 50 is dimensioned such that gaseous refrigerant from the liquid line **30*a* will separate and accumulate in the upper portion of the container 50. This volume of accumulated saturated gas separated from the liquid is introduced into the compression chamber 10 through an injection port 52 (FIGS. 3 and 4) formed in the lower plate 9. The injection port 52 communicates with chamber 10 at a position relative to rotor rotation to be fully explained hereinafter. A gas transfer conduit 54 is connected between an opening 55 in the upper wall of container 50 and the gas injection port 52**.

Referring now to FIGS. 3 and 4, it may be seen that the injection port 52 is closed at all times during the compression cycle of the roller 11 except during the early low pressure period of compression when the contacting tangent peripheral surface of the roller 11 moves from point A through point B shown in FIG. 3 to point C shown in FIG. 4 of the compression chamber 10. The injection of gas from the upper portion of container 50 into the compression chamber starts as the injection port 52 is first exposed when the roller surface tangent with the cylinder wall is at point A. At this point in the cycle, the pressure in chamber 10 is at approximately 73 PSIG. The injection of this added gas continues until cut off by the roller covering the injection port when the roller surface is tangent to the cylinder surface at point C. At this point in the cycle, the pressure in the chamber 10 is at approximately 80 PSIG. It should be understood that the injection port 52 is closed by the action of the rotor 11 while the pressure in the chamber 10 is still below the pressure of the injected gas. This action insures the compressed gas at a higher pressure in the chamber 10 is not forced back into the system through the container 50.

Assuming that the vane 14 and tangent point "A" are at 0° then tangent point "B" is at approximately 55° and point "C" at approximately 110°. In operation, flow of refrigerant through port 52 will start when the roller 11 is tangent at point "A" and will increase as the roller 11 reaches tangent point "B". The port 52 is dimensioned and located so that the maximum flow through port 52 is when the roller tangent is at point "B". From point "B" to point "C", pressure increased in the compression chamber as the roller proceeds into the compression stroke of the cycle and, accordingly, refrigerant flow decreases until port 52 is fully closed.

Referring to the timing of the injected gas and depending upon $\Delta P$ for injected gas pressure, it should be understood that additional $\Delta P$ may be obtained by adding additional conduit restriction between point 53 of volume 50 and liquid line 30 to evaporator 28 without departing from the disclosed invention.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

I claim:

1. A refrigeration system including a condenser, an evaporator, an expansion control means dividing said system between a low and high pressure side and a hermetically sealed rotary refrigerant compressor for forming a closed refrigeration circuit comprising;

a hermetic casing adapted to contain a high pressure refrigerant gas;

a compressor unit in said casing including a cylinder having an annular compression chamber and end walls enclosing the ends of said annular chamber;

a rotor eccentrically rotatable within said chamber, said rotor having a peripheral surface adapted to move progressively into sealing relation with successive portions of said annular chamber;

a motor having a shaft extending through one of said end walls for driving said rotor;

means including a gas discharge port communicating with said high pressure side for conducting hot compressed refrigerant gas for said chamber into said casing and then to said condenser;

means including a gas suction port communicating with said low pressure side for conducting gaseous refrigerant from said evaporation outlet to said chamber;

refrigerant collecting means arranged in the low pressure side at the inlet to said evaporator being dimensioned for separating gaseous uncondensed refrigerant from liquid condensed refrigerant;

means for injecting said uncondensed gaseous refrigerant into said annular chamber including a gaseous refrigerant injection port being positioned to be covered and uncovered by said rotor during rotation thereof;

a refrigerant gas supply means communicating at one end with said refrigerant collecting means and at the other end with said refrigerant gas injection port for conducting uncondensed gas refrigerant when present to said injection port for discharge into said chamber when the pressure in said chamber is less than the pressure in said collecting means so as to prevent back flow of compressed refrigerant into said collecting means.

2. The refrigeration system recited in claim 1 further including a radial slot in said cylinder communicating with said chamber, a blade slidably positioned in said radial slot being biased against said peripheral surface to divide said chamber into high and low pressure sides;

3. The refrigeration system recited in claim 2 wherein said injection port communicates with the high pressure side of said compression chamber so that said uncondensed refrigerant gas is injected into the high pressure side of said chamber;

4. The refrigeration system recited in claim 3 wherein the ends of said rotor engage said end walls and said injection port is formed in one end wall of said cylinder and is covered and uncovered by the end surface of said rotor in engagement with said one end wall.

5. The refrigeration system recited in claim 4 wherein said collector is arranged between said expansion means and said evaporator inlet;

6. The refrigeration system recited in claim 5 wherein said collector includes a casing having a generally cylindrical side wall and top and bottom walls, an inlet opening in said top wall and a liquid outlet opening in said bottom wall.

7. The refrigeration system recited in claim 6 wherein said refrigerant gas supply means is connected to said collecting means inlet opening in the top wall for communicating with the upper portion of said collecting means where gaseous refrigerant, when present, will accumulate.

* * * * *